US009677794B2

(12) United States Patent
Hofbauer

(10) Patent No.: US 9,677,794 B2
(45) Date of Patent: Jun. 13, 2017

(54) HEAT PUMP WITH ELECTROMECHANICALLY-ACTUATED DISPLACERS

(71) Applicant: ThermoLift, Inc., Stony Brook, NY (US)

(72) Inventor: Peter Hofbauer, West Bloomfield, MI (US)

( * ) Notice: Subject to any disclaimer, the term of this patent is extended or adjusted under 35 U.S.C. 154(b) by 0 days.

(21) Appl. No.: 14/391,787

(22) PCT Filed: Apr. 11, 2013

(86) PCT No.: PCT/US2013/036101

§ 371 (c)(1),
(2) Date: Oct. 10, 2014

(87) PCT Pub. No.: WO2013/155258

PCT Pub. Date: Oct. 17, 2013

(65) Prior Publication Data

US 2015/0075209 A1 Mar. 19, 2015

(51) Int. Cl.

| | |
|---|---|
| ***F25B 23/00*** | (2006.01) |
| ***F25B 30/02*** | (2006.01) |
| ***F25B 9/14*** | (2006.01) |

(52) U.S. Cl.
CPC ..... *F25B 30/02* (2013.01); *F25B 9/14* (2013.01)

(58) Field of Classification Search
CPC ..... F25B 13/00; F25B 1/10; F25B 23/003
USPC ..... 62/115, 238.7, 324.1, 517, 526
See application file for complete search history.

(56) References Cited

U.S. PATENT DOCUMENTS

| | | | | |
|---|---|---|---|---|
| 1,275,507 | A | 8/1918 | Vuilleumier | |
| 3,220,178 | A * | 11/1965 | Dineen | F02G 1/043 60/522 |
| 3,774,405 | A | 11/1973 | Leo | |
| 4,195,482 | A * | 4/1980 | Moloney | F02G 1/043 60/517 |
| 4,429,539 | A | 2/1984 | Leach | |
| 4,683,723 | A | 8/1987 | Doi | |
| 5,214,923 | A | 6/1993 | Kown | |
| 5,301,506 | A | 4/1994 | Pettingill | |
| 5,461,869 | A | 10/1995 | Ishino | |
| 5,483,802 | A | 1/1996 | Kawajiri | |
| 5,615,556 | A | 4/1997 | Honda | |
| 5,715,683 | A | 2/1998 | Hofbauer | |

(Continued)

FOREIGN PATENT DOCUMENTS

| | | | |
|---|---|---|---|
| DE | 4206958 | A1 | 9/1993 |
| DE | 19502188 | A1 | 1/1996 |

(Continued)

*Primary Examiner* — Melvin Jones
(74) *Attorney, Agent, or Firm* — Diana D. Brehob

(57) ABSTRACT

A Vuilleumier heat pump is disclosed in which hot and cold displacers are controlled by first and second electromagnetic actuators, respectively. The first actuator is capable of moving the hot displacer between the first and second ends of travel while the cold displacer remains stationary and the second actuator is capable of moving the cold displacer while the hot displacer remains stationary. Prior art crank arrangements are unable to provide dwell in one displacer while moving the other displacer. Actuation of the displacers according to embodiments of the present disclosure provides a higher coefficient of performance than crank arrangements.

25 Claims, 7 Drawing Sheets

(56) References Cited

U.S. PATENT DOCUMENTS

| | | | |
|---|---|---|---|
| 5,737,925 | A | 4/1998 | Sekiya |
| 5,794,444 | A | 8/1998 | Hofbauer |
| 2012/0125001 | A1 | 5/2012 | Ittner |

FOREIGN PATENT DOCUMENTS

| | | | |
|---|---|---|---|
| EP | 81302879.2 | A2 | 6/1982 |
| EP | 0585430 | B1 | 9/1994 |

* cited by examiner

HEAT PUMP WITH ELECTROMECHANICALLY-ACTUATED DISPLACERS

TECHNICAL FIELD

The present disclosure relates to a system and method for pumping fluid in a heat pump.

BACKGROUND

A Vuilleumier heat pump was disclosed in U.S. Pat. No. 1,275,507, filed 29 Jan. 1917. In a Vuilleumier heat pump 10, two displacers (or pistons) are provided in a cylinder 20 and defining three chambers: a hot displacer 12 between a hot chamber 22 and a warm chamber 24 and a cold displacer 16 between the warm chamber 24 and a cold chamber 26, as example of which is shown in FIG. 1. Displacers 12 and 16 reciprocate within cylinder 20 to change the volume of fluid contained in the three chambers. E.g., when hot displacer 12 is an extreme position towards hot chamber 22, most of the fluid is pushed out of hot chamber 22, through a hot heat exchanger 28. Hot heat exchanger 28 is coupled to a burner 27 that is supplied fuel and air. The fluid travels next through a hot recuperator 30, a warm heat exchanger 32, a cold recuperator 34, and a cold heat exchanger 36. Elements 28, 30, 32, 34, and 36 are fluidly coupled to cylinder 20 external to the cylinder and having a passage 38 between warm heat exchanger 32 and warm chamber 24. Displacers 12 and 16 are caused to reciprocate by a crank arrangement 40.

The movement of displacers 12 and 16 as driven by crank arrangement 40 is substantially sinusoidal, as illustrated in FIG. 2. The displacer height and their movement during reciprocation is illustrated as a function of crank angle degree in FIG. 2 and identified as D_h and D_c. The volumes between the hot and cold displacers in the 3 chambers are also illustrates in FIG. 2: V_h, V_w, and V_c. Movement of cold displacer 16 is offset from that of hot displacer 12 by a phase angle, such as 90°. Chambers 22, 24, and 26 are fluidly coupled to each other with little flow restriction. Thus, pressure in the three chambers is substantially the same, but varies as a function of time, as shown in FIG. 3. The pressure in the cylinder rises when flow through hot exchanger 28 raises the overall temperature of the gases within the closed system and the pressure within the cylinder falls when energy is extracted via warm heat exchanger 32.

A Vuilleumier heat pump is a closed thermodynamic cycle in which the working fluid, a gas, remains in the cylinders. Energy is transferred to and from the heat pump through heat exchangers. In a heating mode, energy is transferred to the hot chamber via a burner or other high temperature energy source. Energy is also transferred to the fluid in the cold heat exchanger from the environment. The energy transferred for space heating or hot water heating, as examples, is extracted from the warm chamber via a heat exchanger. Because some of the energy is extracted from the environment, the coefficient of performance substantially exceeds 1 at many operating conditions. This is in comparison to a standard furnace in which the coefficient of performance can at best approach 1 and only in furnaces in which the water vapor in the exhaust is condensed. The heat pump may also be used for cooling by energy extracted in the cold heat exchanger. Vuilleumier heat pumps have been used to develop cryogenic temperatures.

Through modeling of the system, it has been found that coefficient of performance of the system could be improved if one of the displacers could dwell at its extreme position while the other displacer moves and vice versa, rather than having both of them be in continuous movement, i.e., separated by a fixed phase angle.

To obtain reasonable performance in the Vuilleumier heat pump, the working fluid is either hydrogen or helium, which is pressurized to about 100 bar, as a non-limiting example. Pressure is fairly constant throughout the cylinder, but varies as a function of crank angle degree, as shown in FIG. 3.

Preventing leakage of either of these gases is a challenge. In prior art Vuilleumier heat pumps, the rotating crank arrangement to which the displacers are coupled may be located outside the housing such that the moving connecting rods that attach to the displacers pass through the wall of the housing. Sealing around a moving and rocking connecting rod presents a sealing challenge. Alternatively, the rotating crank arrangement is within the sealed housing yielding a heavier, bulkier heat pump.

SUMMARY

To overcome at least one shortcoming in the prior art, a heat pump is disclosed that has: a housing having an outer wall and a cylinder liner within the housing, a hot displacer disposed within the cylinder liner, a hot displacer actuator coupled to at least one of the cylinder and the housing, and an electronic control unit (ECU) electronically coupled to the hot displacer actuator. The ECU may be electronically coupled by a physical connection such as a wire, via wireless communication, or anything suitable. The hot displacer reciprocates within the cylinder between a first end of travel associated with the hot displacer and a second end of travel associated with the hot displacer based on a signal from the ECU to the hot displacer actuator. The hot displacer has a generally cylindrical body, a first cap at a first end of the cylindrical body, and a second cap coupled to a second end of the cylindrical body. The first cap may be integrally formed with the body of the displacer or coupled to the body of the displacer by any suitable method, such as by the following non-limiting examples: friction welding, brazing, welding, gluing, bolting, and clamping. In addition to a substantially cylindrical cross section, the body of the hot displacer can have a cross section of any shape, e.g., oval or polygonal, as non-limiting examples. The heat pump may further include: a cold displacer disposed within the cylinder liner, and a cold displacer actuator that is coupled to at least one of the cylinder and the housing, and is electronically coupled to the ECU. The cold displacer reciprocates within the cylinder between a first end of travel associated with the cold displacer and a second end of travel associated with the cold displacer based on a signal from the ECU to the cold displacer actuator. The cold displacer has a generally cylindrical body, a third cap coupled to a first end of the cylindrical body of the cold displacer, and a fourth cap coupled to a second end of the cylindrical body of the cold displacer.

During operation of the heat pump, the hot displacer has selectable dwell periods at the first and second ends of travel associated with the hot displacer and the cold displacer has selectable dwell periods at first and second ends of travel associated with the cold displacer.

The housing has a hot end and a cold end. The hot displacer actuator is a hot displacer electromechanical device that has a first spring coupled between a first stationary element associated with the heat pump and the hot displacer, a second spring coupled between a second stationary element associated with the heat pump and the hot displacer, an electromagnet associated with the hot displacer that is coupled to a third stationary element associated with the heat pump and electronically coupled to the ECU, a first ferromagnetic element coupled to the hot displacer, and a second ferromagnetic element coupled to the hot displacer. The first spring exerts a force on the hot displacer in a direction toward the cold end of the housing and the second spring exerts a force on the hot displacer in a direction toward the hot end of the housing. The first and second ferromagnetic elements are located a predetermined distance apart as measured along a direction of travel of the hot displacer in the cylinder.

In one embodiment, the first and second stationary elements are coupled to the cylinder; the third stationary element is a centrally-located post rigidly affixed to a cold end of the housing and extending into the housing; the second cap of the hot displacer defines a centrally located opening to accommodate the post passing into the hot displacer; and the first and second springs are located between the cylindrical body of the hot displacer and the cylinder liner.

In another embodiment, the third stationary element comprises a centrally-located post rigidly affixed to a cold end of the housing and extending into the housing; the first and second stationary elements are coupled to the post at a location distal from the cold end of the housing; the second cap of the hot displacer defines a centrally located opening to accommodate the post passing into the hot displacer; and the first and second springs are located inside the hot displacer. Some embodiments also include: a cold displacer disposed within the cylinder liner. The cold displacer has a generally cylindrical body, a third cap coupled to a first end of the cylindrical body of the cold displacer, and a fourth cap coupled to a second end of the cylindrical body of the cold displacer. The heat pump also includes a cold displacer electromechanical device that includes a third spring coupled between a fourth stationary element associated with the heat pump and the cold displacer, a fourth spring coupled between a fifth stationary element associated with the heat pump and the cold displacer, an electromagnet associated with the cold displacer that is coupled to the post and electronically coupled to the ECU; and a third ferromagnetic element coupled to the cold displacer; and a fourth ferromagnetic element coupled to the cold displacer. The first and second caps of the cold displacer define a centrally located opening to accommodate the post passing through the cold displacer and the third and fourth springs are located inside the cold displacer. The third spring exerts a force on the cold displacer in a direction toward the cold end of the housing and the fourth spring exerts a force on the cold displacer in a direction toward the hot end of the housing When the hot displacer is at the first end of travel, the ECU commands the electromagnet to energize with a holding current to act on the first ferromagnetic element to hold the hot displacer at the first end of travel for a first selectable dwell period. After the first dwell period, the ECU commands the electromagnet to de-energize so that the hot displacer moves toward the second end of travel due to unbalanced spring forces acting on the hot displacer. When the hot displacer nears the second end of travel, the ECU commands the electromagnet to energize with a grabbing current sufficient to pull the second ferromagnetic element of the hot displacer so that the hot displacer to move into the second end of travel. When the hot displacer is at the second end of travel, the ECU commands the electromagnet to energize with a holding current to act on the second ferromagnetic element to hold the hot displacer at the second end of travel for a second selectable dwell period. After the second dwell period, the ECU commands the electromagnet to de-energize so that the hot displacer moves toward the first end of travel due to unbalanced spring forces acting on the hot displacer.

In some embodiments, the hot displacer has a first groove in an outer surface of the first cap and a second groove in an outer surface of the second cap. A first sealing ring is provided in the first groove and a second sealing ring is provided in the second groove. The rings ride on a surface of the cylinder liner during reciprocation of the hot displacer.

The housing and the cylinder liner define an annular chamber located between an inner surface of the housing and an outer surface of the cylinder liner. The heat pump may further include a hot recuperator, a warm heat exchanger, a cold recuperator, and a cold heat exchanger disposed in the annular chamber. The warm heat exchanger, the cold recuperator and the cold heat exchanger are arranged in the annular chamber arranged in the listed order with the hot recuperator proximate the hot end of the housing and the cold heat exchanger proximate the cold end of the housing. A hot heat exchanger may also be arranged within the annular chamber proximate the hot end of the housing. A burner may be provided external to the housing with products of combustion from the burner fluidly coupled to the hot heat exchanger.

The hot and cold displacers define three chambers within the housing: a hot chamber proximate the hot end of the housing; a cold chamber proximate the cold end of the housing, and a warm chamber located between the hot and cold displacers. The cylinder liner defines: a first set of openings in the cylinder liner proximate the hot end of the housing to provide fluidic communication between the hot chamber and the annular volume; a second set of openings in a middle of the cylinder liner to provide fluidic communication between the warm chamber and the annular chamber; and a third set of openings in the cold end of the housing that provide fluidic communication between the cold chamber and the annular chamber.

According to other embodiments, a system for pumping fluid within a heat pump includes: a housing having a cylinder therein; a hot displacer disposed within the cylinder and having a body, a first cap coupled to a first end of the body, and a second cap coupled to a second end of the body; a hot actuator coupled to the hot displacer; and an electronic control unit (ECU) electronically coupled to the hot actuator. The hot displacer moves between a first end of travel and a second end of travel. The hot displacer dwells at the first end of travel for a first selectable period and the hot displacer dwells at the second end of travel for a second selectable period. The system may further include a cold displacer disposed within the cylinder and having a body, a third cap coupled to a first end of the body of the cold displacer and a fourth cap coupled to a second end of the body of cold displacer; and a cold actuator coupled to the cold displacer and electronically coupled to the ECU. The hot actuator allows dwell of the hot displacer while the cold displacer moves and the second actuator allows dwell of the cold displacer while the hot displacer moves. Dwell refers to maintaining one of the displacer in a fixed position, e.g., causing the hot displacer to stay at the first end of travel for a selectable period.

The hot actuator may include a centrally-located post rigidly affixed to a cold end of the housing and extending into the housing, first and second springs coupled between the post and the hot displacer, first and second ferromagnetic elements affixed to the hot displacer, and a first electromagnet coupled to the post at a location between the first and second ferromagnetic elements. The first ferromagnetic element being displaced from the second ferromagnetic element by a predetermined distance as measured along a central axis of the cylinder. The cold actuator includes: third and fourth springs coupled between the post and the cold displacer, third and fourth ferromagnetic elements affixed to the cold displacer; and a second electromagnet coupled to the post at a location between the third and fourth ferromagnetic elements. The third ferromagnetic element is displaced from the fourth ferromagnetic element by the predetermined distance as measured along a central axis of the cylinder.

A method to operate a heat pump is disclosed in which the cold actuator is commanded to move the cold displacer from its first end of travel to its second end of travel while commanding the hot actuator to maintain the hot displacer at its first end of travel. The method may further include commanding the hot actuator to move the hot displacer from its second end of travel to its first end of travel while commanding the cold actuator to maintain the cold displacer at its second end of travel.

The first spring exerts a force on the associated displacer in a direction toward the cold end; the second spring exerts a force on the associated displacer in a direction toward the hot end; and the electromagnet is adapted to attract the ferromagnetic block or element when the electromagnet is energized.

The hot actuator causes the hot displacer to move from a lower position to an upper position by de-energizing the electromagnet; energizing the electromagnet with a grabbing current when the upper ferromagnetic block approaches the electromagnet due to the hot displacer moving due to unbalanced spring forces; and energizing the electromagnet with a holding current when the upper ferromagnetic block approaches the electromagnet.

An advantage according to embodiments of the present disclosure is that a higher coefficient of performance, in both cooling and heating, is provided due to the more desirable movement of the displacers, for example, the ability to hold the hot displacer in place while moving the cold displacer. In contrast, prior art heat pumps have the two displacers moving continuously with a constant phase angle difference.

Yet another advantage of the present disclosure is that the actuators are enclosed within the housing of the heat pump. This greatly aids in keeping the helium, hydrogen, or other low molecular weight working fluid sealed within the housing.

Vuilleumier heat pumps, in which the displacers reciprocate substantially sinusoidally with a 90° phase shift between the two, use a warm heat exchanger, such as shown in FIG. 1 as element 32. The alternative system for actuating displacers per embodiments described herein in which one of the displacers dwells at an extreme position while the other displacer moves, does not rely on a second warm heat exchanger between the warm chamber 24 and the cold recuperator 34. Obviating one warm heat exchanger is another advantage provided by disclosed embodiments.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
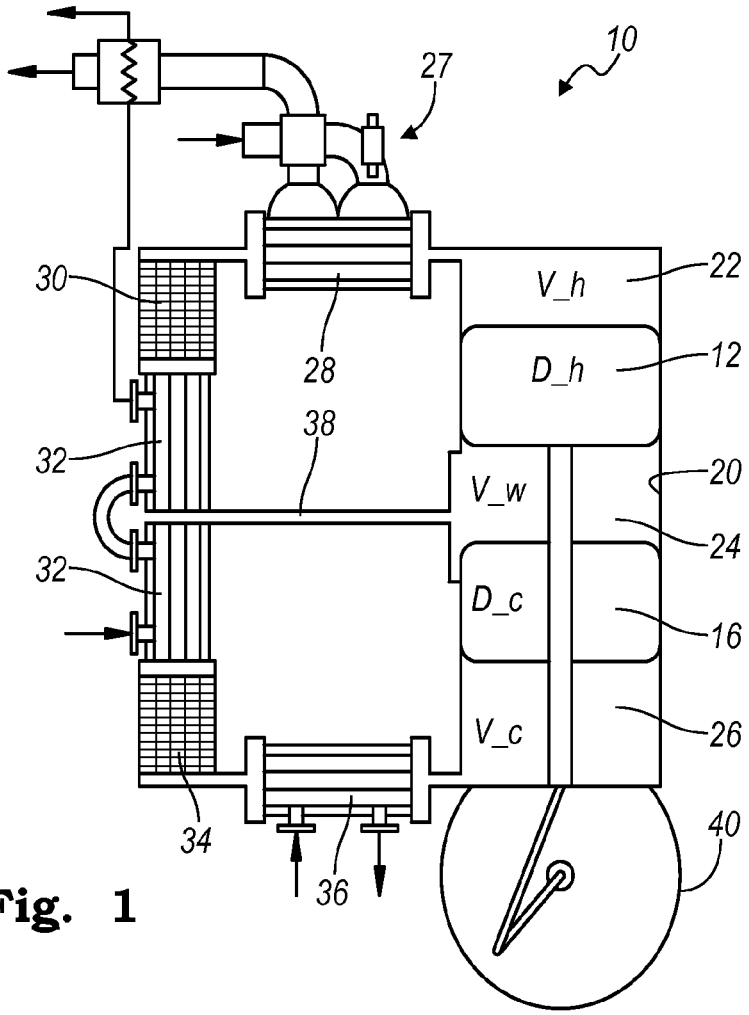
FIG. 1 is a schematic of a Vuilleumier heat pump.
Figure 2:
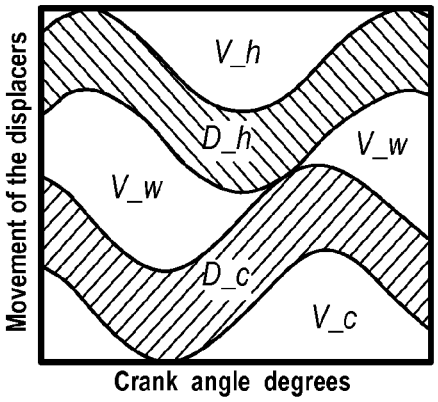
FIG. 2 is a graph indicating the sinusoidal movement of displacers in a Vuilleumier heat pump and the volumes in the three chambers.
Figure 3:
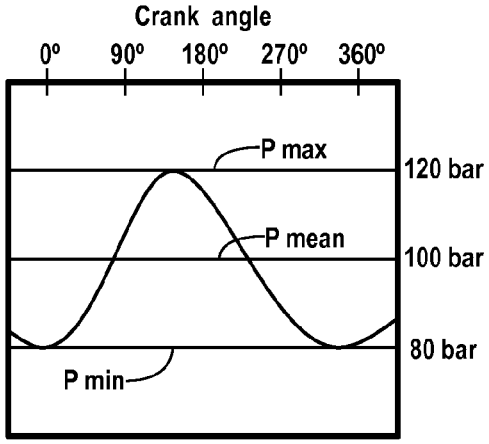
FIG. 3 is a graph illustrating pressure within the Vuilleumier heat pump as the displacers move according to FIG. 2.
Figure 4:
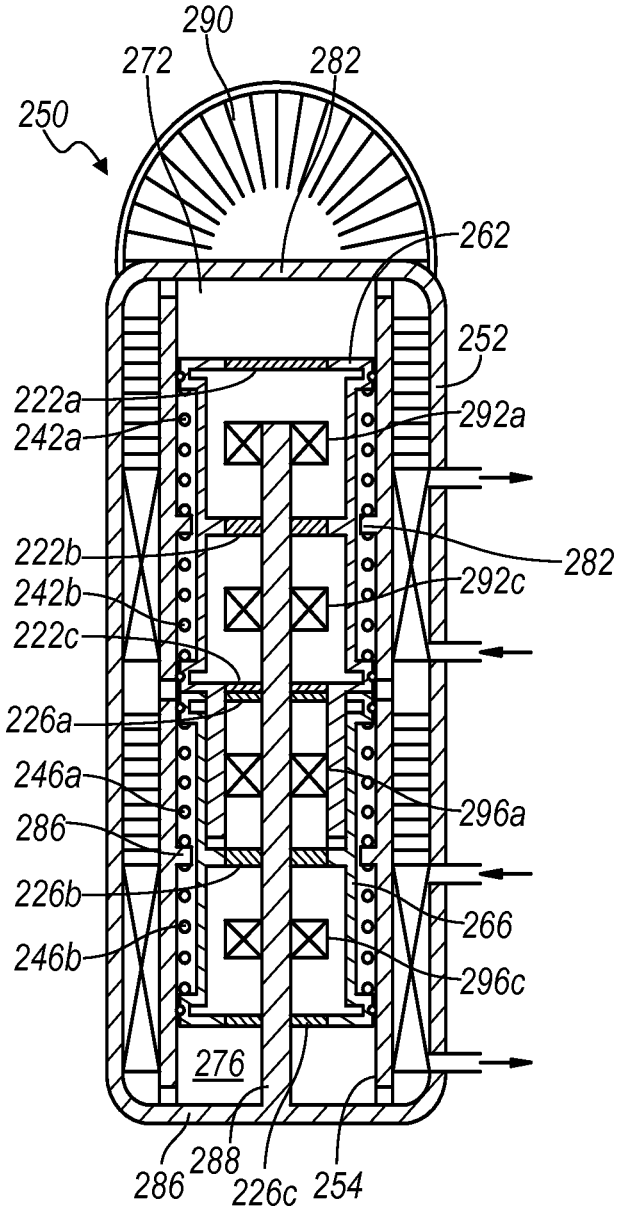
FIGS. 4-6 are illustrations of Vuilleumier heat pumps according to embodiments of the present disclosure.

In FIG. 4, one embodiment of a heat pump 250 has a housing 252. A cylinder liner 254 is provided in housing 252. Hot and cold displacers 262 and 266, respectively, are shown in their neutral position, i.e., not at either end of travel. The displacers define three chambers: a hot chamber 272, a warm chamber, and a cold chamber 276. With the positions of displacers 262 and 266 as illustrated in FIG. 4, the warm chamber has no volume and is thus not provided a numeral. Housing 252 has a hot end 282 and a cold end 286.

A post 288 is affixed to the cold end 286 of housing 252 and extends into housing 252 along a central axis of housing 252. Post 288 extends through cold displacer 266 and extends into one end of hot displacer 262. Post 288 has electromagnets 292*a* and 292*c* disposed within hot displacer 262 and electromagnets 296*a* and 296*c* disposed within cold displacer 266.

Ferromagnetic elements or blocks 222*a*, 222*b*, and 222*c* are affixed to hot displacer 262. Blocks 222*a*, 222*b*, and 222*c* are displaced from each other by predetermined distances as measured in a direction along the axis of housing 252. The predetermined distances are related to the desired travel of hot displacer 262. Ferromagnetic blocks 226*a*, 226*b*, and 226*c* are affixed to cold displacer 266. Blocks 226*a*, 226*b*, and 226*c* are displaced from each other by predetermined distances as measured in a direction along the axis of housing 252.

In the embodiment in FIG. 4, one end of a spring 242*a* is attached to a top end of hot displacer 262 and the other end of spring 242*a* to a tab 282. A second spring 242*b* is attached to tab 282 on one end and to a bottom end of hot displacer 262. Similarly, cold displacer has springs 246*a* and 246*b* that couple between a tab 286 and top and bottom ends of cold displacer 266.

Figure 5:
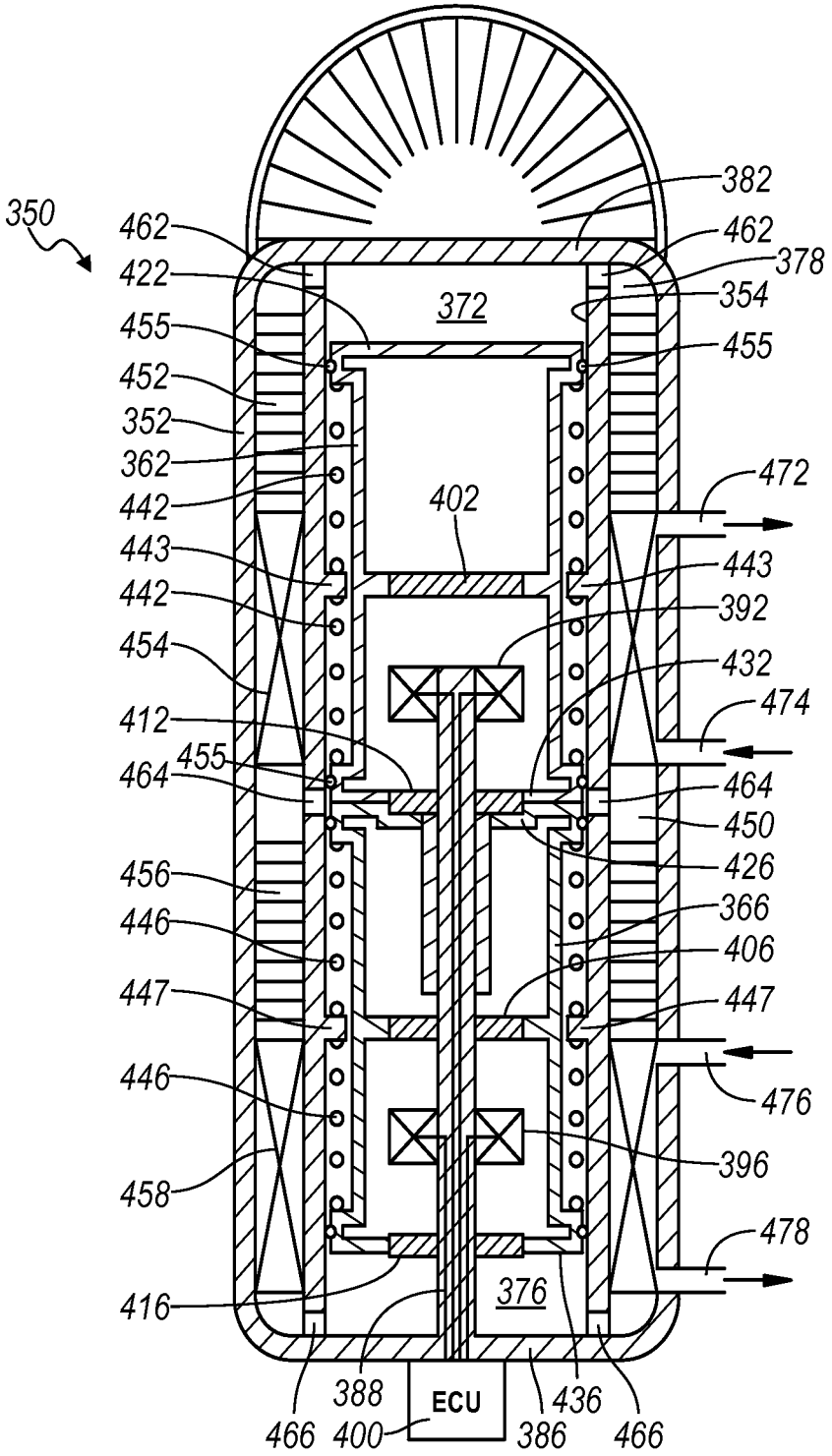

Another embodiment shown in FIG. 5, a heat pump 350 has a housing 352 in which a hot displacer 362 and a cold displacer 366 are disposed in a cylinder 354. A hot chamber 372 is defined between a hot end 382 of housing 352 and hot displacer 362. A cold chamber 376 is defined between a cold end 386 of housing 352 and cold displacer 366. A hot actuator that can move hot displacer 362 includes: two blocks 402 and 412 which may be made of a ferromagnetic material and an electromagnet 392 that can be energized under control by an electronic control unit (ECU) 400 to grab one or the other of blocks 402 and 412 to cause hot displacer 362 to move. Hot displacer also has two springs 442, one of which is coupled between a cap 422 and tab 443 that is part of cylinder 354 and the other of which coupled between a cap 432 and tab 443. Tab 443 can be a cylindrical lip or multiple tabs provided on the circumference of cylinder 354 to provide an attachment for the springs. In some embodiments, caps 422 and 432 are provided with seals 455 that ride on cylinder 354 during reciprocation. Similarly, a cold actuator to move cold displacer 366 includes: two blocks 406 and 416 which can be attracted by electromagnet 396 controlled by ECU 400. The cold actuator also has springs 446, one of which is coupled between a tab 447 and a cap 426 of cold displacer 366 and the other of which is coupled between tab 447 and a cap 436 of cold displacer.

Electromagnets 392 and 396 are mounted on a centrally-located post 388 that is coupled to the cold end 386 of housing 352. Post 388 extends through the end caps of cold displacer 366 and through cap 432 of hot displacer 362. Electrical wires to energize the electromagnets travel through post 388.

Springs 446 are in compression the upper of which exerts a downward force and the lower of which exerts and upward force. Cold displacer 366 is in equilibrium in FIG. 5 with the spring forces counteracting each other. Electromagnet 396 can be actuated to cause cold displacer 366 to move from the equilibrium position.

When the displacers move, fluid in the various chambers is pushed out from the chamber into an annular chamber 378 that is between the inner surface of housing 352 and the outer surface of cylinder 354. Openings are provided in cylinder 354 to allow flow between the chambers within cylinder 354 and annular chamber 378 outside of cylinder 354. Openings 462 allow flow between hot chamber 372 and annular chamber 378; openings 464 allow flow between a warm chamber (has no volume in the equilibrium position shown in FIG. 5) and annular chamber 378; and openings 466 allow flow between cold chamber 376 and annular chamber 378.

Annular chamber 378 has a hot recuperator 452, a warm heat exchanger 454, a cold recuperator 456, and a cold heat exchanger 458 are disposed in annular chamber 378. When heat pump 350 is operated in a heating mode, water or other fluid is provided through warm heat exchanger 454 through inlet 474 and outlet 472 that pierce housing 352. Alternatively, flow through heat exchanger 454 is a reverse direction to that shown in FIG. 5. In both the heat and cooling modes, a fluid is provided through cold heat exchanger 458 that has inlet 476 and outlet 478 that pierce housing 352.

The thermodynamic cycle efficiency is improved by reducing dead volume in the heat pump. Volume in the annular chamber is part of the dead volume. Also, the volume in which the springs are located at the outside of the displacer is a dead volume. It is desirable to make the recuperators and heat exchangers as compact as possible to reduce the volume. In another embodiment in FIG. 6, the springs are provided inside the displacers.

Figure 6:
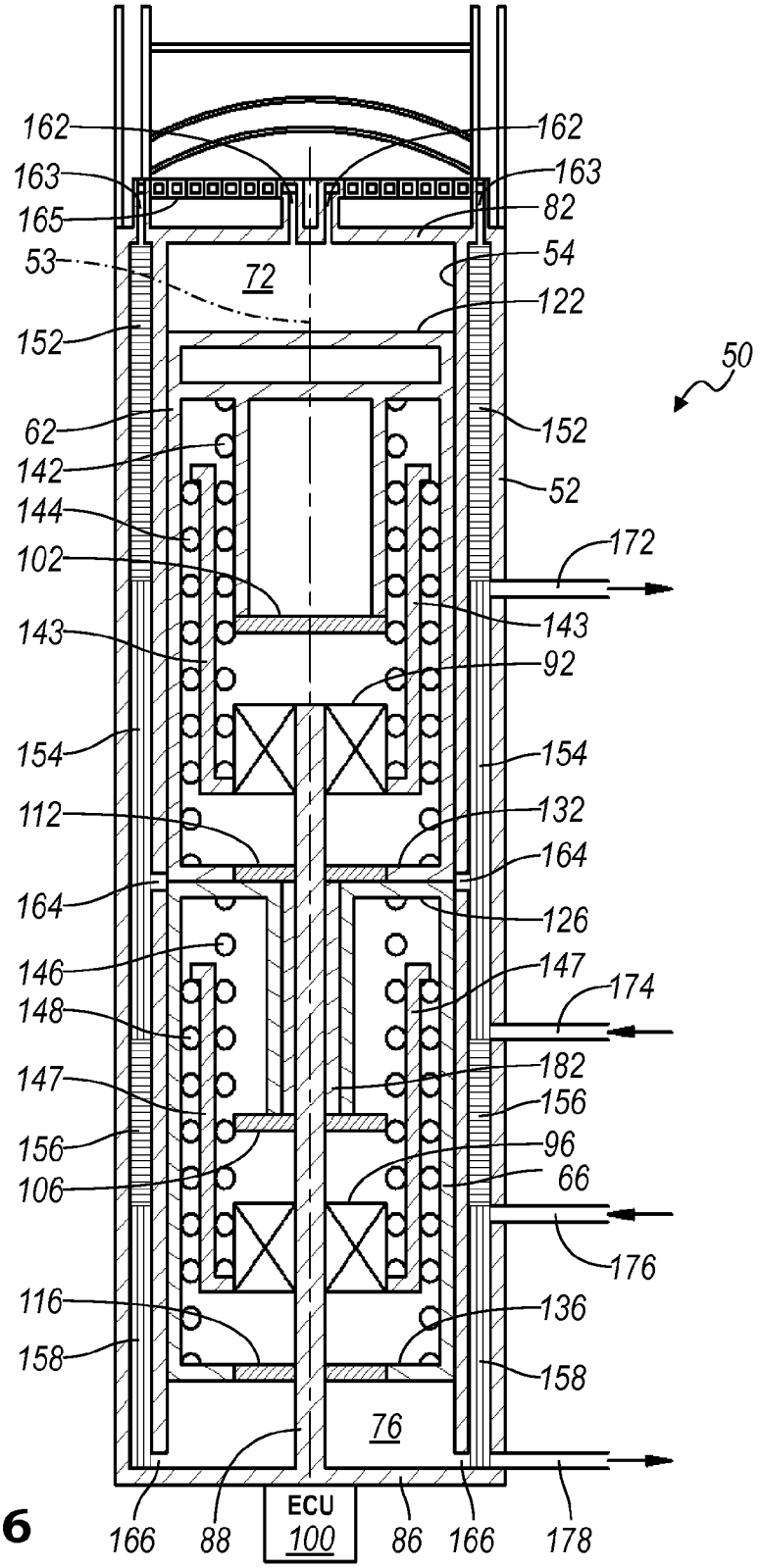

Referring now to FIG. 6, a heat pump 50 has a housing 52 and a cylinder 54 into which hot displacer 62 and cold displacer 66 are disposed. Displacers 62 and 66 reciprocate within cylinder liner 54 moving along central axis 53. An actuator for hot displacer 62 includes: ferromagnetic elements 102 and 112, electromagnet 92, springs 142 and 144, and a support structure 143. Support structure 143, as shown in FIG. 6 is attached to the electromagnet 92, which is coupled to a central post 88 that is coupled to a cold end 86 of housing 52. Post 88, electromagnet 92, and support structure 143 are stationary. When hot displacer 62 reciprocates upward from the position shown in FIG. 6, spring 142 is compressed to a greater degree than its equilibrium preload and 144 is under a lower compression. Electromagnet 92 is energized to pull ferromagnetic elements 102 or 112 toward it, against the spring forces of springs 142 and 144. Analogously, cold displacer 66 has a cold actuator that includes: an electromagnet 96 coupled to post 88, a support structure 147 coupled to electromagnet 96, and springs 146 and 148. Spring 146 is coupled between support structure 147 and a first cap 126 of cold displacer 66. Spring 148 is coupled between support structure 147 and a second cap 136 of cold displacer 66. Electromagnet 92 and 96 are controlled via an electronic control unit (ECU) 100.

Ferromagnetic blocks 102, 112, 106, and 116 are coupled to: a standoff associated with a first cap 122 of hot displacer 62, a second cap 132 of hot displacer 62, a standoff associated with first cap 126 of cold displacer 66, and second cap 136 of cold displacer 66, respectively. Openings are provided in second cap 132 of hot displacer 62, and first and second caps 126 and 136 of cold displacer 66 to accommodate post 88 extending upwardly through cold displacer 66 and into hot displacer 62.

An annular chamber is formed between a portion of the inner surface of housing 52 and the outer surface of cylinder 54. A hot recuperator 152, a warm heat exchanger 154, a cold recuperator 156, and a cold heat exchanger 158 are disposed within the annular chamber. Openings through cylinder 54 allow fluid to pass between the interior of cylinder 54 to the annular chamber. Openings 166 allow for flow between a cold chamber 76 and cold heat exchanger 158 in the annular chamber. Openings 164 allow flow between a warm chamber (which has substantially no volume when the displacers are in the position shown in FIG. 6) and the annular chamber. Heat pump 50 also has a hot heat exchanger 165 that is provided near a hot end 82 of housing 52. Openings 162 through cap 82 lead to heat exchanger 165 which has passages 163 that lead to the annular chamber. Hot heat exchanger 165 may be associated with a burner arrangement or other energy source.

Continuing to refer to FIG. 6, a fluid that is to be heated flows to warm heat exchanger 154 into opening 174 and out opening 172, cross flow. Fluid that is to be cooled flows to cold heat exchanger 158 in at opening 176 and exits at opening 178. The flow through the heat exchangers may be reversed, parallel flow.

Figure 7:
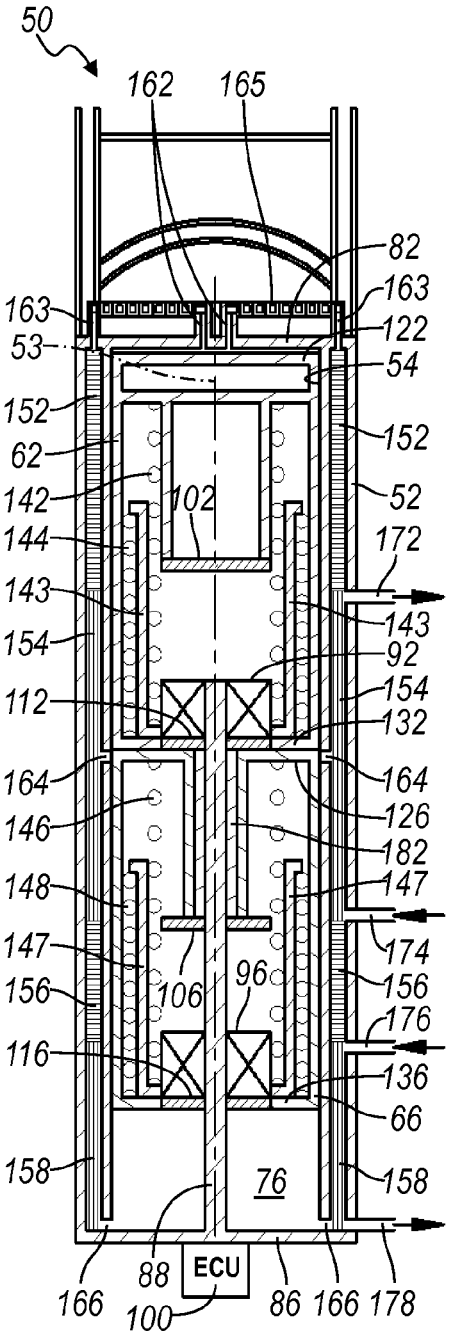
FIGS. 7-10 are schematic illustrations of a Vuilleumier-type heat pump in which the displacers are shown in their ends of travel used to describe a cycle in which the heat pump may be operated.

Referring to illustrations in FIGS. 7-10, an example thermodynamic cycle is described. In FIG. 7, heat pump 50 is shown with both displacers at the upward end of their travel. Ferromagnetic element 112 is drawn to electromagnet 92. Electromagnet 92 is energized with a holding current sufficient to hold hot displacer 62 against the unbalanced spring force exerting a downward force on hot displacer. Similarly, ferromagnetic member 116 is drawn to electromagnet 96 with sufficient holding current to hold cold displacer 66 at the upper extreme position against the unbalanced spring force. The working fluid within housing 52 is primarily contained within cold chamber 76 and the annular chamber with the recuperators and heat exchangers. There is very little fluid within the hot and warm chambers.

Figure 8:
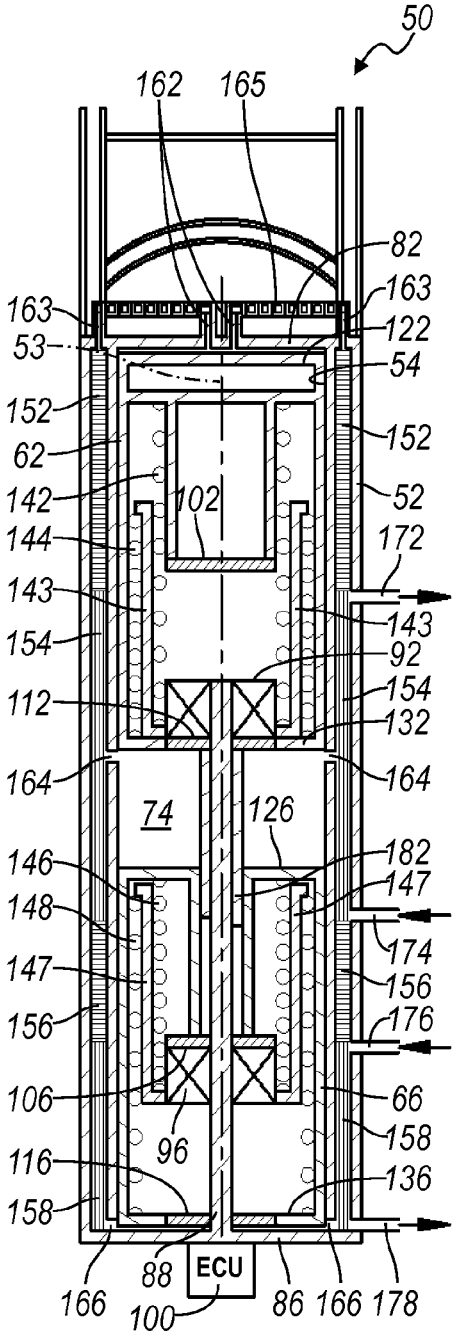

In FIG. 8, the cold displacer 66 has moved from the upper end of travel to the lower end of travel. In this configuration, almost no fluid is contained in either the cold chamber or the hot chamber. Instead, the working fluid if found in warm chamber 74 and some in the annular chamber. From the position of cold displacer 66 shown in FIG. 7 to attain the position shown in FIG. 8, electromagnet 96 that had been holding ferromagnetic member 116 is de-energized. The unbalanced spring force causes cold displacer 66 to travel downward. As ferromagnetic block 106 approaches electromagnet 96, a grabbing current is applied to the electromagnet 96 so that it draws ferromagnetic block 106 into electromagnet 96. After ferromagnetic block 106 is in contact with electromagnet 96, a lesser holding current is commanded to electromagnet to hold block 106 against the balanced spring forces.

Figure 9:
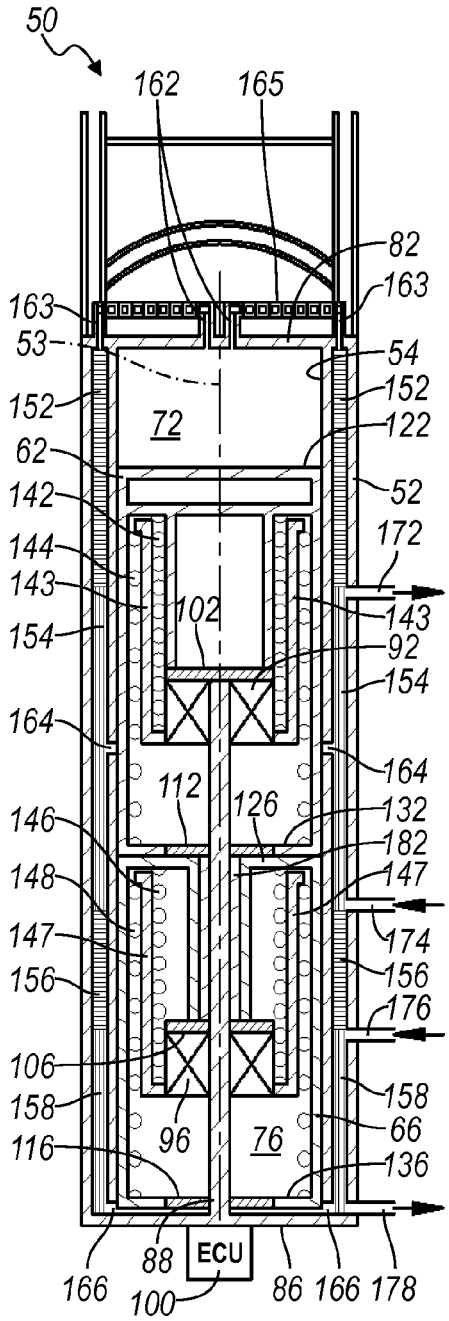

Referring now to FIG. 9, both displacers 62 and 66 are shown in their lower extreme positions. The majority of the working fluid within cylinder 52 is within hot chamber 72. Hot displacer 62 moves from the upper end of travel shown in FIG. 8 to the lower end of travel shown in FIG. 9 when electromagnet 92 is de-energized so that the unbalanced spring force acts on hot displacer 62 to cause it to move downwardly. When ferromagnetic block 102 of hot displacer 62 approaches electromagnet 92, a grabbing current is commanded to electromagnet 92. Once ferromagnetic block 102 is in contact with electromagnet 92, electromagnet is commanded to hold block 102 with a holding current.

Figure 10:
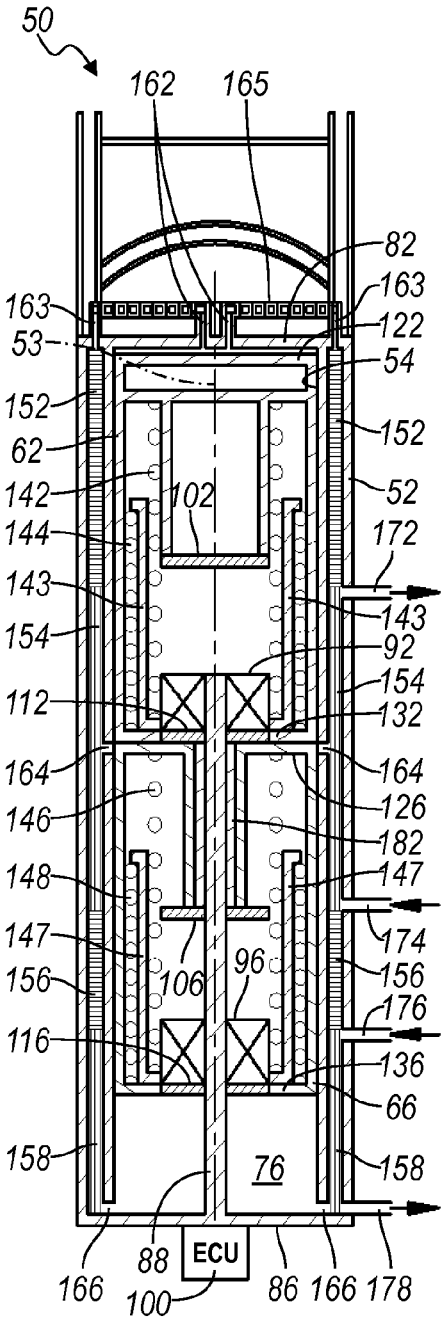

Between FIGS. 9 and 10, both displacers 62 and 66 move from their lower extreme positions closer to cold end 86 and their upper extreme positions closer to hot end 82. Both electromagnets 92 and 96 are de-energized to allow the displacer to move under control of the springs, then energized with a grabbing current when the displacer approaches the other end of travel to pull the displacer in, and then energized with a holding current to retain the displacer in place. Note that the cycle is complete as the displacer positions in FIGS. 7 and 10 are identical.

When cold displacer 66 moves between the positions shown in FIGS. 7 and 8, fluid is pushed out of cold chamber 76 and into warm chamber 74 via the annular chamber. When hot displacer 62 moves between the positions shown in FIGS. 8 and 9, fluid is pushed out of warm chamber 74 and into hot chamber 72 via the annular chamber. Finally, when both displacers 62 and 66 move upward to their ends of travel when moving from the position shown in FIG. 9 to that in FIG. 10, fluid is pushed out of hot chamber 72 through the annular chamber into cold chamber 76.

The embodiment in FIG. 6-10 uses no seals between the displacer (62 and 66) and cylinder liner 54. In some embodiments, the displacer may seal sufficiently well against the cylinder to obviate the need of seals which can increase friction. The pressure within the housing is substantially similar throughout. Of course, when the displacers move, a pressure difference is created that is sufficient to overcome the pressure drop in the annular space, i.e., to cause the fluid to flow among the hot, cold, and warm chambers through the elements in the annular space. However, if the pressure drop is low enough and depending on the speed of operation of the heat pump, seals may be omitted.

In prior art heat pumps with a crank arrangement to drive the displacers, the displacer is not allowed to dwell at any particular position, but is in continuous movement. According to embodiments of the present disclosure, not only can the displacer dwell at their extreme positions, but for a selectable period. For some operating conditions, it may be desirable for the displacer to dwell longer at one its ends of travel longer than at the other end of travel, which embodiments disclosed herein allow. The heating or cooling output can be adjusted by increasing or decreasing the dwell period, essentially changing the frequency of reciprocation, according to disclosed embodiments.

Figure 11A:
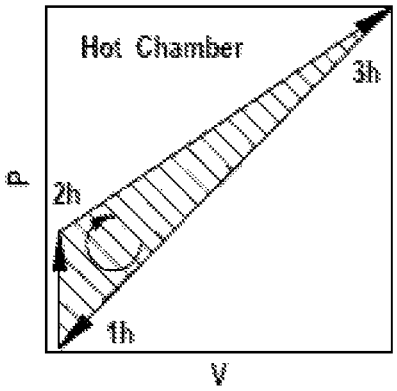
FIGS. 11A-C illustrate thermodynamic cycles associated with the hot, cold, and warm chambers, respectively.
Figure 11B:
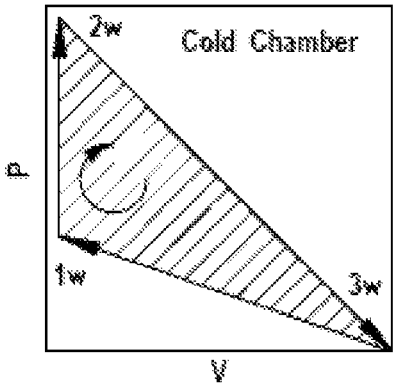
Figure 11C:
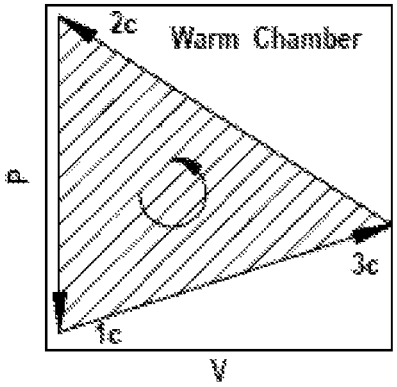

The thermodynamic processes that the working fluid undergoes in the hot (h), cold (c), and warm (w) chambers undergo are illustrated in FIGS. 11A-C, respectively, in which the axes are P, for pressure, and V, for volume. The points 1h, 2h, and 3h correspond to the thermodynamic state associated with FIG. 11A; 1w, 2w, and 3w with FIG. 11B; and 1c, 2c, and 3c with FIG. 11C. By computing area over a cycle, i.e., the integral of V-dp, heat transferred in undergoing that cycle can be determined. In the situation in FIGS. 11A and 11B the cycle is clockwise and indicates heat transfer to the system. In FIG. 11C, the cycle is counter clockwise and indicates heat transfer out of the system. The temperatures in the chambers are maintained substantially constant at ~600° C., ~50° C., and ~−5° C. for the hot, warm, and cold chambers, respectively. (The temperatures are provided by way of example and not intended to be limiting.) The processes in FIGS. 11A-C are shown as straight lines. In reality, the real processes deviate from straight lines, some of the processes being properly represented by curved lines. Thus, FIGS. 11A-C are illustrative only. In a heating mode, energy is transferred from the warm heat exchanger to the space to be heated (e.g., home) or hot water heater. In a cooling mode, energy is transferred to the cold heat exchanger from the space to be cooled.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art with respect to one or more characteristics are not outside the scope of the disclosure and may be desirable for particular applications.

I claim:

1. A heat pump, comprising:

a housing having an outer wall and a cylinder liner within the housing;

a hot displacer disposed within the cylinder liner, the hot displacer having a generally cylindrical body, a first cap at a first end of the cylindrical body, and a second cap coupled to a second end of the cylindrical body;

a hot displacer actuator coupled to at least one of the cylinder liner and the housing;

a cold displacer disposed within the cylinder liner, the cold displacer having a generally cylindrical body, a third cap at a first end of the cylindrical body of the cold displacer, and a fourth cap coupled to a second end of the cylindrical body of the cold displacer;

a cold displacer actuator that: is coupled to at least one of the cylinder liner and the housing; and an electronic control unit (ECU) electronically coupled to the hot displacer actuator and the cold displacer actuator wherein:

the hot displacer reciprocates within the cylinder liner between a first end of travel associated with the hot displacer and a second end of travel associated with the hot displacer based on a signal from the ECU to the hot displacer actuator;

the cold displacer reciprocates within the cylinder liner between a first end of travel associated with the cold displacer and a second end of travel associated with the cold displacer based on a signal from the ECU to the cold displacer actuator; and during operation of the heat pump, the hot displacer has selectable dwell periods at the first and second ends of travel associated with the hot displacer; and the cold displacer has selectable dwell periods at first and second ends of travel associated with the cold displacer.

2. The heat pump as claimed in claim 1 wherein:

the housing has a hot end and a cold end;

the hot displacer actuator is a hot displacer electromechanical device that includes:

a spring within the cylinder liner arranged symmetrically with respect to a central axis of the cylinder liner and coupled between a first stationary element associated with the heat pump and the hot displacer;

an electromagnet associated with the hot displacer that is coupled to a second stationary element associated with the heat pump and electronically coupled to the ECU; and a ferromagnetic element coupled to the hot displacer.

3. The heat pump as claimed in claim 2 wherein:

the first and second stationary elements are coupled to the cylinder liner; and the second cap of the hot displacer defines a centrally located opening.

4. The heat pump as claimed in claim 2 wherein:

the second stationary element comprises a centrally-located post rigidly affixed to a cold end of the housing and extending into the housing;

the second cap of the hot displacer defines a centrally-located opening to accommodate the post passing into the hot displacer; and the spring is located inside the hot displacer.

5. The heat pump as claimed in claim 1 wherein the cold displacer actuator is a cold displacer electromechanical device that comprises:

a spring within the cylinder liner arranged symmetrically with respect to a central axis of the cylinder liner and coupled between a third stationary element associated with the heat pump and the cold displacer;

an electromagnet associated with the cold displacer that is coupled to the post and electronically coupled to the ECU; and a ferromagnetic element coupled to the cold displacer; wherein the third and fourth caps of the cold displacer define a centrally-located opening to accommodate the post passing through the cold displacer.

6. The heat pump as claimed in claim 2, wherein:

when the hot displacer is at the first end of travel, the ECU commands the electromagnet to energize with a holding current to act on the ferromagnetic element to hold the hot displacer at the first end of travel for a selectable dwell period; and after the first dwell period, the ECU commands the electromagnet to de-energize so that the hot displacer moves toward the second end of travel due to unbalanced spring forces acting on the hot displacer.

7. The heat pump as claimed in claim 1, wherein the hot displacer has a first groove in an outer surface of the first cap and a second groove in an outer surface of the second cap, the heat pump further comprising:

a first sealing ring disposed in the first groove; and a second sealing ring disposed in the second groove wherein the rings ride on a surface of the cylinder liner during reciprocation of the hot displacer.

8. The heat pump as claimed in claim 1, wherein: the housing and the cylinder liner define an annular chamber located between an inner surface of the housing and an outer surface of the cylinder liner, the heat pump further having: a hot recuperator; a warm heat exchanger; a cold recuperator; and a cold heat exchanger disposed in the annular chamber; and the hot recuperator, the warm heat exchanger, the cold recuperator and the cold heat exchanger are disposed in the annular chamber arranged in the given order with the hot recuperator proximate the hot end of the housing and the cold heat exchanger proximate the cold end of the housing.

9. The system of claim 8, further comprising: a hot heat exchanger disposed within the annular chamber proximate the hot end of the housing.

10. The heat pump claimed in claim 9, further comprising: a burner provided external to the housing with products of combustion from the burner fluidly coupled to the hot heat exchanger.

11. The heat pump claimed in claim 8 wherein: the housing comprises a hot end and a cold end; the housing and the cylinder liner define an annular chamber located between an inner surface of the housing and an outer surface of the cylinder liner; the hot and cold displacers define three chambers within the housing: a hot chamber proximate the hot end of the housing; a cold chamber proximate the cold end of the housing, and a warm chamber located between the hot and cold displacers; and the cylinder liner defines:

a first set of openings in the cylinder liner proximate the hot end of the housing to provide fluidic communication between the hot chamber and the annular volume;

a second set of openings in a middle of the cylinder liner to provide fluidic communication between the warm chamber and the annular chamber; and a third set of openings in at a second end of the housing that provide fluidic communication between the cold chamber and the annular chamber.

12. A system for pumping fluid within a heat pump, comprising:

a housing having a cylinder therein;

a hot displacer disposed within the cylinder and having a body, a first cap coupled to a first end of the body, and a second cap coupled to a second end of the body;

a hot actuator coupled to the hot displacer; and an electronic control unit (ECU) electronically coupled to the hot actuator wherein the hot displacer moves between a first end of travel and a second end of travel; the hot displacer dwells at the first end of travel for a first selectable period and the hot displacer dwells at the second end of travel for a second selectable period.

13. The system of claim 12, further comprising:

a cold displacer disposed within the cylinder and having a body, a third cap coupled to a first end of the body of the cold displacer and a fourth cap coupled to a second end of the body of the cold displacer; and a cold actuator coupled to the cold displacer and electronically coupled to the ECU;

wherein the hot actuator allows dwell of the hot displacer while the cold displacer moves and the cold actuator allows dwell of the cold displacer while the hot displacer moves.

14. The system of claim 13 wherein the hot actuator comprises:

a first spring within the cylinder arranged symmetrically with respect to a central axis of the cylinder and coupled to the hot displacer;

a first ferromagnetic element coupled to the hot displacer; and a first electromagnet coupled to a first stationary element; and the cold actuator comprises:

a second spring arranged symmetrically with respect to the central axis of the cylinder and coupled to the cold displacer;

a second ferromagnetic element coupled to the cold displacer; and a second electromagnet.

15. A method to operate a heat pump wherein:

the heat pump includes:

a housing having a hot end and a cold end;

a cylinder liner disposed within the housing;

a hot displacer disposed within the cylinder liner and adapted to reciprocate therein;

a cold displacer disposed within the cylinder liner and adapted to reciprocate therein;

a hot actuator coupled to the hot displacer; and a cold actuator coupled to the cold displacer; and each of the cold and hot displacers have a first end of travel nearer the hot end and a second end of travel nearer the cold end;

the method comprising:

commanding the cold actuator to move the cold displacer from its first end of travel to its second end of travel while commanding the hot actuator to maintain the hot displacer at its first end of travel; and commanding the hot actuator to move the hot displacer from its second end of travel to its first end of travel while commanding the cold actuator to maintain the cold displacer at its second end of travel.

16. The method of claim 15 wherein each actuator comprises:

an electromagnet coupled to the housing;

a ferromagnetic block coupled to the associated displacer; and a spring with a centerline substantially coincident with a centerline of the cylinder liner coupled between the associated displacer and a stationary element coupled to the housing;

wherein:

the electromagnet is adapted to attract the ferromagnetic block when the electromagnet is energized.

17. The method of claim 16 wherein the hot actuator causes the hot displacer to move from its first end of travel to its second end of travel by:

de-energizing the electromagnet.

18. The system of claim 14, wherein:

when the hot displacer is at the first end of travel, the ECU commands the first electromagnet to energize with a holding current to act on the first ferromagnetic element to hold the hot displacer at the first end of travel for a first selectable dwell period; and after the first dwell period, the ECU commands the first electromagnet to de-energize to allow the hot displacer to move toward the second end of travel due to unbalanced spring forces acting on the hot displacer.

19. The system of claim 12 wherein:

the housing has a hot end and a cold end;

the hot actuator is a hot displacer electromechanical device that includes:

a first spring within the cylinder arranged symmetrically with respect to a central axis of the cylinder and coupled between a first stationary element associated with the heat pump and the hot displacer;

a first electromagnet associated with the hot displacer that is coupled to a second stationary element associated with the heat pump and electronically coupled to the ECU; and a first ferromagnetic element coupled to the hot displacer.

20. The system of claim 19, further comprising:

a cold displacer disposed within the cylinder and having a body, a third cap coupled to a first end of the body of the cold displacer and a fourth cap coupled to a second end of the body of the cold displacer; and a cold actuator coupled to the cold displacer and electronically coupled to the ECU, the cold actuator comprises:

a second spring within the cylinder arranged symmetrically with respect to the central axis of the cylinder and coupled between a third stationary element associated with the heat pump and the cold displacer;

a second electromagnet associated with the cold displacer that is coupled to the third stationary element and electronically coupled to the ECU; and a second ferromagnetic element coupled to the cold displacer.

21. The system of claim 20 wherein the third stationary element is a centrally-located post rigidly affixed to a cold end of the housing and extending into the housing.

22. The system of claim 12, wherein the hot displacer has a first groove in an outer surface of the first cap and a second groove in an outer surface of the second cap, the heat pump further comprising:

a first sealing ring disposed in the first groove; and a second sealing ring disposed in the second groove wherein the rings ride on a surface of the cylinder liner during reciprocation of the hot displacer.

23. The system of claim 12, further comprising:

an outer wall surrounding the cylinder wherein the housing and the cylinder define an annular chamber located between an inner surface of the housing and an outer surface of the cylinder.

24. The system of claim 13, further comprising:

an outer wall surrounding the cylinder wherein: the housing and the cylinder define an annular chamber located between an inner surface of the housing and an outer surface of the cylinder; the housing has a hot end and a cold end; the hot and cold displacers define three chambers within the housing: a hot chamber proximate the hot end of the housing; a cold chamber proximate the cold end of the housing, and a warm chamber located between the hot and cold displacers; and the cylinder defines:

a first set of openings in the cylinder proximate the hot end of the housing to provide fluidic communication between the hot chamber and the annular volume;

a second set of openings in a middle of the cylinder to provide fluidic communication between the warm chamber and the annular chamber; and a third set of openings in the cylinder proximate the cold end of the housing that provide fluidic communication between the cold chamber and the annular chamber.

25. The system of claim 24, further comprising:

a hot recuperator disposed in the annular chamber; and a cold recuperator disposed in the annular chamber.

* * * * *